US006190000B1

(12) United States Patent
Krouss et al.

(10) Patent No.: US 6,190,000 B1
(45) Date of Patent: Feb. 20, 2001

(54) METHOD AND APPARATUS FOR MASKING ADDRESS OUT FAILURES

(75) Inventors: Paul R. Krouss, Barcelona (ES); Joseph M. Torgerson, Philomath, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/385,800

(22) Filed: Aug. 30, 1999

(51) Int. Cl.[7] ..... B41J 2/145; B41J 2/15; B41J 29/38

(52) U.S. Cl. ..... 347/40; 347/9

(58) Field of Search ..... 347/40, 65, 12, 347/9, 50

(56) References Cited

U.S. PATENT DOCUMENTS

| | | | | |
|---|---|---|---|---|
| 4,999,646 | | 3/1991 | Trask | 347/41 |
| 5,030,971 | | 7/1991 | Drake et al. | 347/57 |
| 5,541,629 | * | 7/1996 | Saunders et al. | 347/12 |
| 5,604,519 | | 2/1997 | Keefe et al. | 347/13 |
| 5,644,342 | | 7/1997 | Argyres | 347/12 |
| 5,648,804 | | 7/1997 | Keefe et al. | 347/47 |
| 5,648,805 | | 7/1997 | Keefe et al. | 347/65 |
| 5,648,806 | | 7/1997 | Steinfield et al. | 347/87 |
| 5,946,012 | * | 8/1999 | Courian et al. | 347/63 |

* cited by examiner

*Primary Examiner*—Thinh Nguyen
(74) *Attorney, Agent, or Firm*—Kevin B. Sullivan

(57) ABSTRACT

The present disclosure relates to a method and apparatus for accomplishing inkjet printing. One aspect of the present invention is an inkjet printhead for use in an inkjet printing system for depositing ink on media. The inkjet printhead has a plurality of drop generators disposed on the printhead that are responsive to first and second select signals for selectively depositing ink on media. The inkjet printhead includes a plurality of contacts for receiving first and second select signals from the inkjet printing system. Also included is a plurality of electrical conductors each electrically connected between the plurality of contacts and selected drop generators of the plurality of drop generators, wherein in a multi-pass print-mode, the plurality of electrical conductors arc connected to the plurality of drop generators to uniformly distribute error resulting from a failure of one of the plurality of electrical conductors to provide one of the first and second select signals to the plurality of drop generators.

28 Claims, 12 Drawing Sheets

| Resistor Range in Swath | 0 | 1-24 | 25-48 |
|---|---|---|---|
| Address 1 Resistors Overlapping Swath | N/A | 1 | 28,37 |
| Dot Row Position | N/A | 1 | (28-24) → 4, 13 ← (37-24) |

| | | | | |
|---|---|---|---|---|
| Resistor Range in Swath | 49-72 | 73-96 | 97-120 | 121-144 |
| Address 1 Resistors Overlapping Swath | 64 | 91, 82 | 118 | 127 |
| Dot Row Position | 16 ← (64-48) | (91-72) → 19, 10 ← (82-72) | 22 ← (118-96) | (127-120) → 7 |

METHOD AND APPARATUS FOR MASKING ADDRESS OUT FAILURES

BACKGROUND OF THE INVENTION

This invention relates to inkjet printers and the like, and more particularly to an inkjet printing system that makes use of multi-pass printing to form images and text on print media.

Inkjet printing systems frequently make use of an inkjet printhead mounted to a carriage which is moved back and forth across print media such as paper. As the printhead is moved across the print media, a control device selectively activates a plurality of drop generators within the printhead to eject or deposit ink droplets onto the print media to form images and text characters. An ink supply that is either carried with the printhead or remote from the printhead provides ink for replenishing the plurality of drop generators.

Individual drop generators are selectively activated by the use of a select or an enable signal that is provided by the printing system to the printhead. In the case of thermal inkjet printing, each drop generator is activated by passing an electric current through a resistive element such as a resistor. In response to the electric current the resistor produces heat, that in turn, heats ink in a vaporization chamber adjacent the resistor. Once the ink reaches vaporization, a rapidly expanding vapor front forces ink within the vaporization chamber through an adjacent orifice or nozzle. Ink droplets ejected from the nozzles are deposited on print media to accomplish printing.

The electric current is frequently provided to individual resistors or drop generators by a switching device such as a field effect transistor (FET). The switching device is activated by a control signal that is provided to the control terminal of the switching device. Once activated the switching device enables the electric current to pass to the selected drop generator or resistor. The electric current or drive current provided to each resistor is sometimes referred to as a primitive signal and a control signal for selectively activating the switching device associated with each resistor is sometimes referred to as an address signal.

In one previously used arrangement, a plurality of primitive signals are provided with each of the plurality of primitive signals connected to a different group of drop generators within the inkjet printhead. Each of a plurality of address signals is provided to each switching device associated with each drop generator. Using this technique a drive signal is provided to each primitive containing a drop generator that is to be activated. The address signal is provided to each primitive to select the particular drop generator for activation within the primitive or grouping of drop generators. The use of this technique reduces the number of signals required to uniquely select and activate individual drop generators.

The above-described scheme for activating selected drop generators within the inkjet printhead is susceptible to certain failure modes that can result in deleterious effects on print quality. For example, a failure of one of the address lines to provide an address signal to each of the primitives or groupings of drop generators results in a failure of each drop generator associated with that particular address line in each primitive. The problem tends to be further exacerbated in printheads that have larger numbers of drop generators. These printheads tend to have larger numbers of primitives producing larger number of drop generator failures because each address line is connected to a drop generator in each primitive.

An address line can fail to provide a proper address or enable signal to drop generators in each of the primitives in several ways. Because each address signal is received from the inkjet printing system, a failure of the electrical interconnect between the printer portion and the printhead can produce a failure of one or more address lines. The electrical interconnect between the printhead and the printing system can fail as a result from improper seating during the installation of the print cartridge or from corrosion or contamination on one or more electrical contacts associated with either the printing system or the print cartridge. Improper seating or corrosion can result in either no electrical interconnect or a high resistance electrical interconnect between the printing system and the ink cartridge. If this electrical contact between the printing system and the ink cartridge is sufficiently high resistance, then the address signal will be sufficiently attenuated to prevent proper activation of the drop generators associated with this address line.

Another cause of an address line failure is failure in the electrical interconnect between the flexible circuit and the contact pads on the printhead. Frequently, an electrical interconnect such as a flexible circuit is used to route signals from the contact pads that are configured for connection to the printing system and a silicon substrate on which the drop generators are defined. Tape automated bonding (TAB) is frequently used to form the electrical interconnect between the flexible circuit and contact pads on the silicon substrate. Failure of this TAB bonding to form good electrical connection between the flexible circuit and the silicon substrate can produce an address line defect.

Finally, various defects on the printhead itself can also result in the failure of address signals in reaching the corresponding drop generators. One example of a die defect is a failure in one or more layers of the printhead to properly channel ink to desired locations on the die which can result in ink shorts or low resistance electrical paths. These electrical paths or ink shorts can attenuate an address signal sufficiently to prevent proper activation of the corresponding drop generators.

There is an ever-present need for inkjet printing systems that produce high print quality and which are highly reliable. These inkjet printing systems should be well-suited for high volume manufacturing in order to provide relatively low per page printing cost.

SUMMARY OF THE INVENTION

The present invention is a method and apparatus for accomplishing inkjet printing. One aspect of the present invention is an inkjet printhead for use in an inkjet printing system for depositing ink on media. The inkjet printhead has a plurality of drop generators disposed on the printhead that are responsive to first and second select signals for selectively depositing ink on media. The inkjet printhead includes a plurality of contacts for receiving first and second select signals from the inkjet printing system. Also included is a plurality of electrical conductors each electrically connected between the plurality of contacts and selected drop generators of the plurality of drop generators. The plurality of electrical conductors are connected to the plurality of drop generators such that in a multi-pass print-mode error resulting from a failure of one of the plurality of electrical conductors to provide one of the first and second select signals to the plurality of drop generators is uniformly distributed.

In one preferred embodiment, the first select signal is an address signal and the second select signal is a primitive drive signal, wherein error is an error resulting from a failure of one of the plurality of electrical conductors to provide an address signal to the plurality of drop generators. In one preferred embodiment, the uniform distribution of the error is a fixed number of print lines between each print line that is affected by the failure of one of the electrical conductors to provide the address select signal.

DETAILED DESCRIPTION OF THE PREFERRED EMBODIMENT

Figure 1:
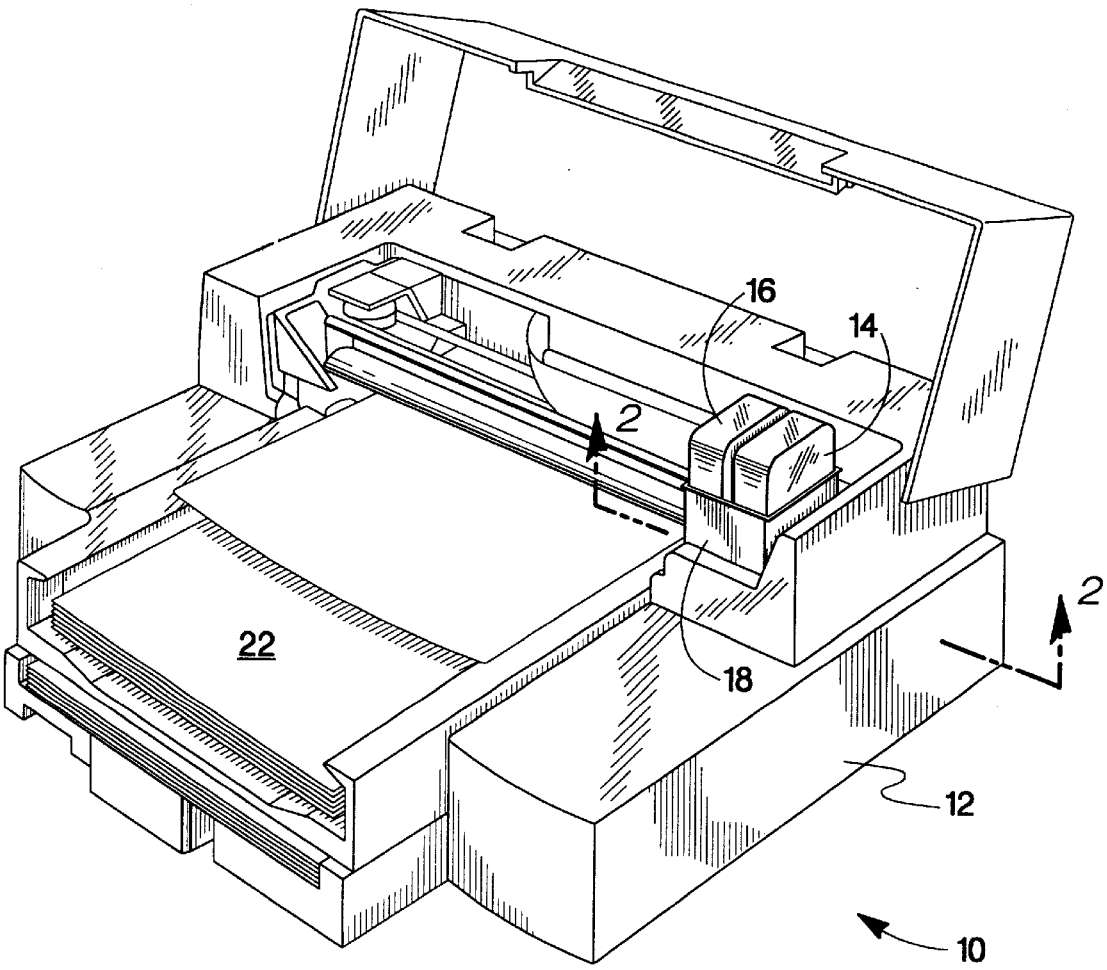
FIG. 1 depicts a printing system of the present invention that incorporates an inkjet print cartridge of the present invention for accomplishing printing on print media shown in a top perspective view.

FIG. 1 is a perspective view of one exemplary embodiment of an inkjet printing system 10 of the present invention shown with its cover open. The inkjet printing system 10 includes a printer portion 12 having at least one print cartridge 14 and 16 installed in a scanning carriage 18. The printing portion 12 includes a media tray 20 for receiving media 22. As the print media 22 is stepped through a print zone, the scamning carriage 18 moves the print cartridges 14 and 16 across the print media. The printer portion 12 selectively activates drop generators within a printhead portion (not shown) associated with each of the print cartridges 14 and 16 to deposit ink on the print media to thereby accomplish printing.

An important aspect of the present invention is a method and apparatus in which the printer portion 12 moves the print cartridges 14 and 16 relative to the print media 22 as well as the selection of drop Generators associated with the printing cartridges 14 and 16. Another aspect of the present invention is the grouping of the drop generators and the particular order in which the drop generators are activated in response to activation signals from the printer portion 12. The method and apparatus of the present invention provides high quality printed images in the multi-pass printing mode even if there is a failure which prevents some of these activation signals from reaching corresponding drop generators.

The method and apparatus of the present invention solves this failure of an enable signal problem by properly arranging the enable signal routing to ensure that print rows printed using defective drop generators due to an enable signal out condition are not adjacent each other. In the preferred embodiment of the present invention, the enable scheme for each of the drop generators ensures that print rows printed with defective drop generators are uniformly spaced, thereby uniformly distributing error due to the enable out signal within the print swath. In this mainer, greater reliability and higher fault tolerance are achieved with the printing system 10 of the present invention. The method and apparatus of the present invention will be described in more detail with respect to FIGS. 2 through 13.

Figure 2:
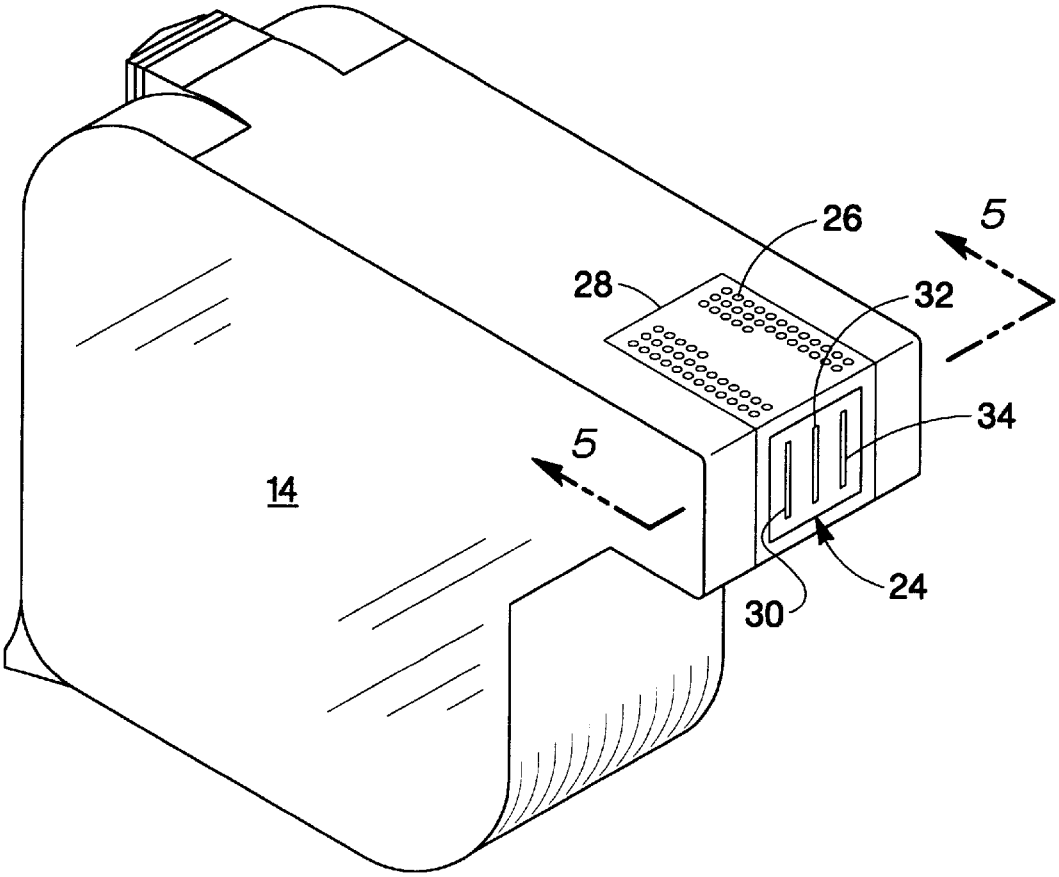
FIG. 2 depicts the inkjet print cartridge shown in FIG. 1 in isolation and viewed from a bottom perspective view.

FIG. 2 depicts a bottom perspective view of one preferred embodiment of the print cartridge 14 shown in FIG. 1. In the preferred embodiment, the cartridge 14 is a 3 color cartridge containing cyan, magenta, and yellow inks. In this preferred embodiment, a separate print cartridge 16 is provided for black ink. The present invention will herein be described with respect to this preferred embodiment by way of example only. There are numerous other configurations in which the method and apparatus of the present invention is also suitable. For example, the present invention is also suited to configurations wherein the printing system contains separate print cartridges for each color of ink used in printing. Alternatively, the present invention is applicable to printing systems wherein more than 4 ink colors are used such as in high-fidelity printing wherein 6 or more ink colors are used. Finally, the present invention is applicable to various types of print cartridges such as print cartridges which include an ink reservoir as shown in FIG. 2, or for print cartridges which are replenished with ink from a remote source of ink, either continuously or intermittently.

The ink cartridge 14 shown in FIG. 2 includes a printhead portion 24 that is responsive to activation signals from the printing system 12 for selectively depositing ink on media 22. In the preferred embodiment, the printhead 24 is defined on a substrate such as silicon. The print cartridge 14 includes a plurality of electrical contacts 26 that are disposed and arranged on the print cartridge 14 so that when properly inserted into the scanning carriage, electrical contact is established between corresponding electrical contacts (not shown) associated with the printer portion 12. Each of the electrical contacts 26 is electrically connected to the printhead 24 by each of a plurality of electrical conductors (not shown). In this manner, activation signals from the printer portion 12 are provided to the inkjet printhead 24.

In the preferred embodiment, the electrical contacts 26 are defined in a flexible circuit 28. The flexible circuit 28 includes an insulating material such as polyimide and a conductive material such as copper. Conductors are defined within the flexible circuit to electrically connect each of the electrical contacts 26 to electrical contacts defined on the printhead 24. The printhead 24 is mounted and electrically connected to the flexible circuit 28 using a suitable technique such as tape automated bonding (TAB).

In the preferred embodiment, the print cartridge is a 3 color cartridge containing yellow, magenta, and cyan inks within a corresponding reservoir portion. The printhead 24 includes drop ejection or drop generator portions 30, 32 and 34 for ejecting ink corresponding, respectively, to yellow, magenta, and cyan inks. The electrical contacts 26 include electrical contacts associated with activation signals for each of the yellow, magenta, and cyan drop generators 30, 32, 34, respectively.

Figure 3:
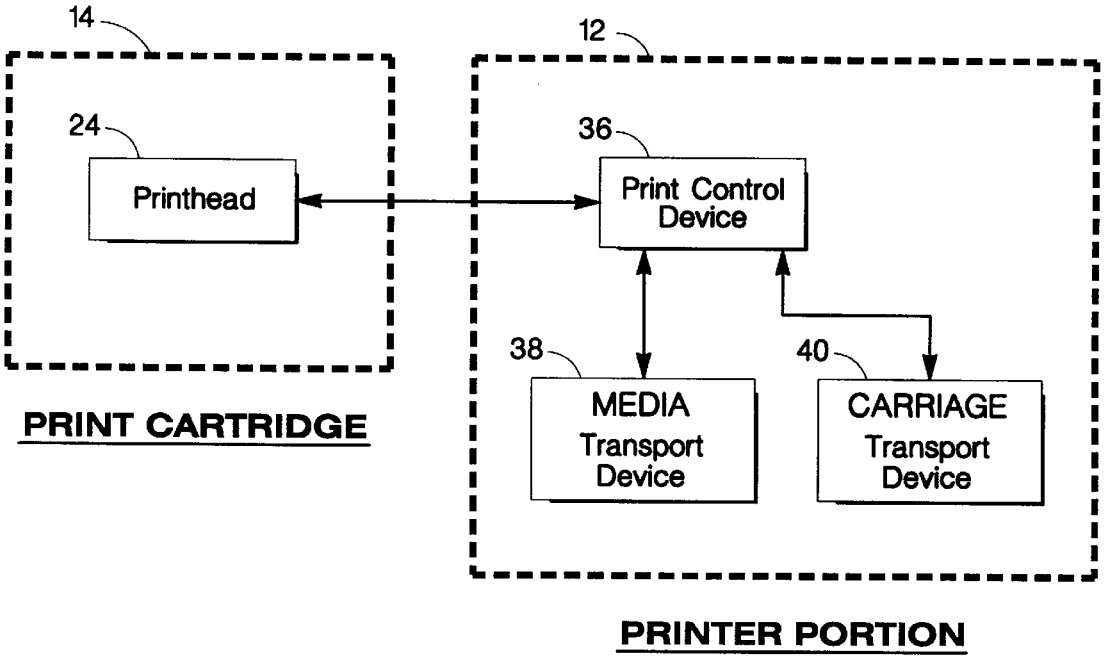
FIG. 3 depicts a simplified block diagram of the printing system shown in FIG. 1.

FIG. 3 depicts a simplified electrical block diagram of the printer portion 12 and one of the print cartridges 14. The printer portion 12 includes a print control device 36, a media transport device 38 and a carriage transport device 40. The print control device 36 provides control signals to the media transport device 38 to pass the media 22 through a print zone whereupon ink is deposited on the print media 22. In addition, the print control device 36 provides control signals for selectively moving the scanning carriage 18 across the media 22, thereby defining a print zone. As the media 22 is stepped past the printhead 24 or through the print zone the scanning carriage 18 is scanned across the print media 22. While the printhead 24 is scanned the print control device 36 provides activation signals to the printhead 24 to selectively deposit ink on print media to accomplish printing.

FIG. 3 is simplified to show only a single print cartridge 14. In general, the print control device 36 is electrically connected to each of the print cartridges 14 and 16. The print control device 36 provides activation signals to selectively deposit ink corresponding to each of the ink colors to be printed.

Figure 4:
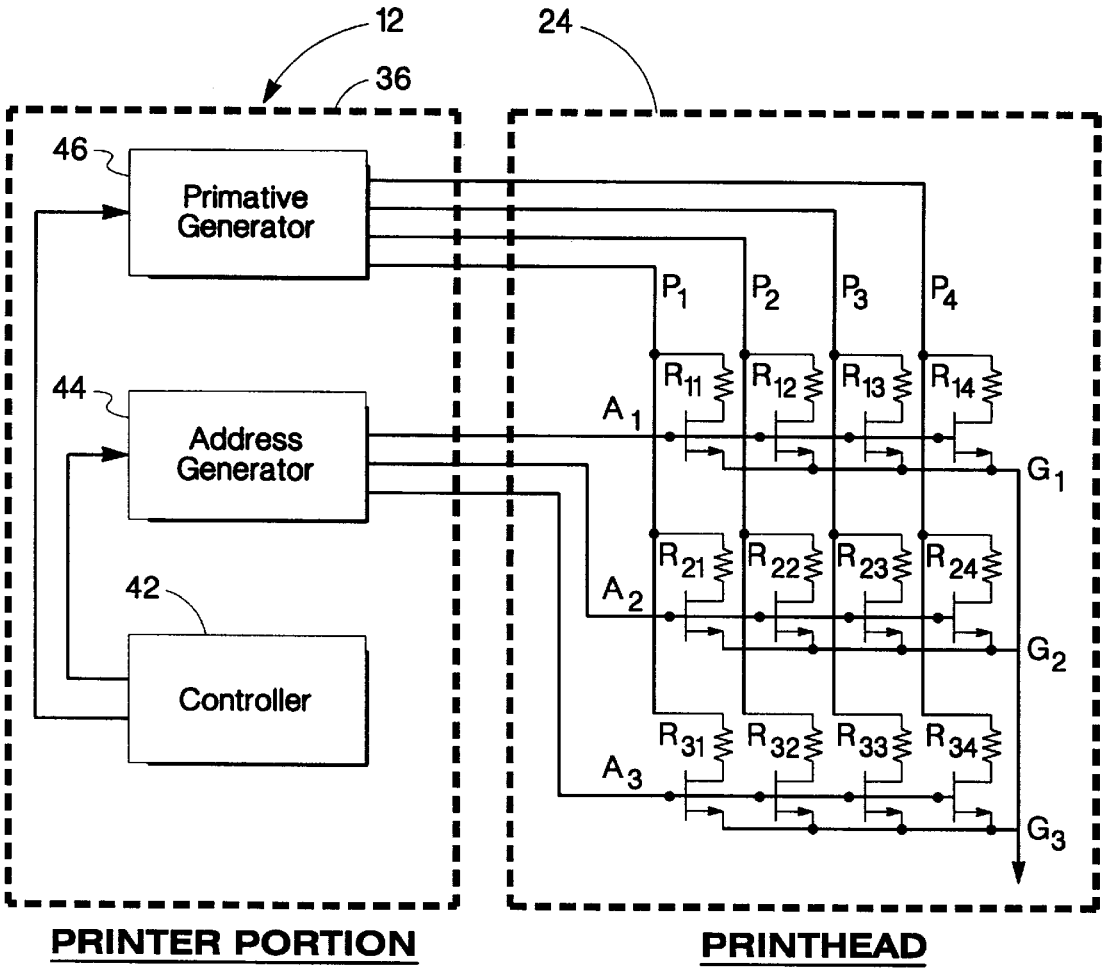
FIG. 4 depicts a simplified block diagram of the printing system shown in FIG. 1, illustrating a printhead having 9 drop generators.

FIG. 4 depicts a simplified electrical block diagram showing greater detail of the print control device 36 within the printer portion 12 and the printhead 24 within the print cartridge 14. The print control device 36 includes a controller 42, an address generator 44, and a primitive generator 46. The address generator 44 and primitive generator 46 provide address and primitive signals under control of the controller 42 to the printhead 24 for selectively activating each of a plurality of drop generators associated therewith.

The printhead 24 is shown greatly simplified by showing 12 drop generators along with corresponding switching circuitry. In general the printhead 24 will have a much larger number of drop generators as will be discussed with respect to FIG. 6 and Table 1 herein.

The simplified printhead portion 24 shown herein includes 12 drop generators having a corresponding resistor represented by $R_{11}$, $R_{12}$, $R_{13}$, $R_{14}$, $R_{21}$, $R_{22}$, $R_{23}$, $R_{24}$, $R_{31}$, $R_{32}$, $R_{33}$, and $R_{34}$. Resistors are used to represent the individual drop generators because in the case of thermal inkjet printing, each drop generator includes an ink chamber, a resistive element disposed proximate the ink chamber, and an orifice or a nozzle adjacent the ink chamber. The drop generator is activated by passing an electric current through a resistor producing heat sufficient to vaporize a portion of the fluid within the chamber. As this vapor front expands, ink within the chamber is forced from an adjacent orifice or nozzle onto print media 22. The present invention is suitable for other technologies such as technologies wherein individual drop generators are activated by an electric signal such as piezo teclnology for ejecting ink droplets.

In the preferred embodiment, the printhead 24 is a thermal inkjet printhead. Each of the resistors associated with individual drop generators are activated by the print control device 36. In the preferred embodiment, this activation signal is a high current drive signal provided by the primitive generator and a relative low current control signal provided by the address generator 44. In this preferred embodiment, each resistor or drop generator is grouped into groups referred to as primitives. Each primitive or group of drop generators is connected to a separate conductor or drive conductor for providing the activation signal to each of the primitives.

In the example shown in FIG. 4, the printhead 24 includes a first primitive which includes resistors $R_{11}$, $R_{21}$, and $R_{31}$, which are each connected to the primitive drive conductor $P_1$, from primitive generator 46. Primitive generator 46 provides three additional primitive drive conductors, $P_2$, $P_3$, and $P_4$. Primitive drive conductor $P_2$ is electrically connected to resistors $R_{12}$, $R_{22}$, and $R_{32}$. Primitive drive conductor $P_3$ is connected to resistors $R_{13}$, $R_{23}$, and $R_{33}$. Finally, primitive conductor $P_4$ is connected to resistors $R_{,4}$, $R_{24}$, and $R_{34}$.

Connected between each of the resistors and a circuit ground is a switching device such as a field effect transistor (FET). The control terminal of each of the switching devices receives an activation signal from the address generator 44. Once activated, the switching device conducts current to allow current to flow from the primitive generator drive circuit 46 to the circuit ground. Therefore, in this particular implementation, each drop generator requires both a drive current provided by the primitive generator 46 and an address active signal provided by the address generator 44 to activate the particular drop generator to deposit ink on media.

In the preferred embodiment, each address line designated $A_1$, $A_2$, and $A_3$ provided by the address generator 44 is connected to only one switching device within each primitive group. Therefore, address 1, designated $A_1$, is connected to the control terminals of switching devices associated with resistors $R_{11}$, $R_{12}$, $R_{,13}$, and $R_{,14}$. Similarly, address 2, designated $A_2$, is connected to the control terminals of switching devices associated with resistors $R_{21}$, $R_{22}$, $R_{23}$, and $R_{24}$. Finally, address 3, designated $A_3$, is electrically connected to the control terminals of switching devices associated with resistors $R_{31}$, $R_{32}$, $R_{33}$, and $R_{34}$.

In the simplified example of the printhead 24 shown in FIG. 4, 7 inputs are required to uniquely select and activate one of 12 drop generators. Using this scheme, the number of inputs that are required to uniquely select N drop generators will be equal to $2\sqrt{N}$. Each individual drop generator within each primitive has a unique address and each address is connected to each primitive. If no more than one address is active at the same time then no more than one drop generator within the same primitive will be active at the same time.

Figure 5:
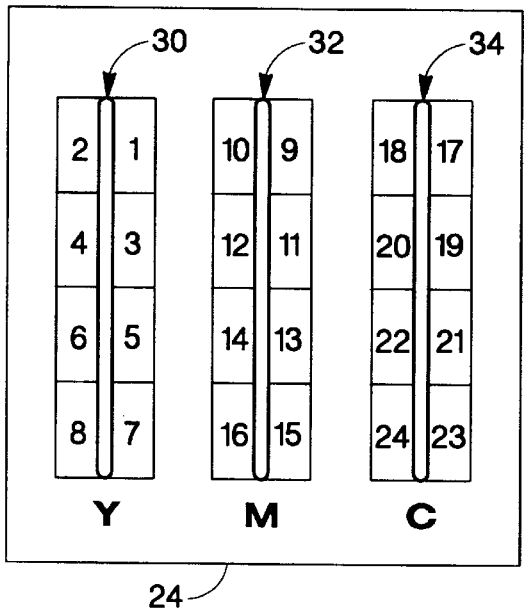
FIG. 5 depicts a schematic representation of a 3-color printhead shown in FIG. 2 with drop generators grouped into 8 primitives.

FIG. 5 is a bottom plan view of the inkjet printhead 24 as shown in FIG. 2. The inkjet printhead 24, includes drop generators 30, 32, and 34 for depositing yellow, magenta, and cyan inks, respectively, on print media. The drop generators associated with each particular ink, yellow, magenta, and cyan, are grouped into groupings referred to as primitives. In the preferred embodiment, there are 8 primitives associated with each ink color. Primitives one through 8 are associated with yellow ink; primitives 9 through 16 are associated with magenta ink; and primitives 17 through 24 are associated with cyan ink.

Figure 6:
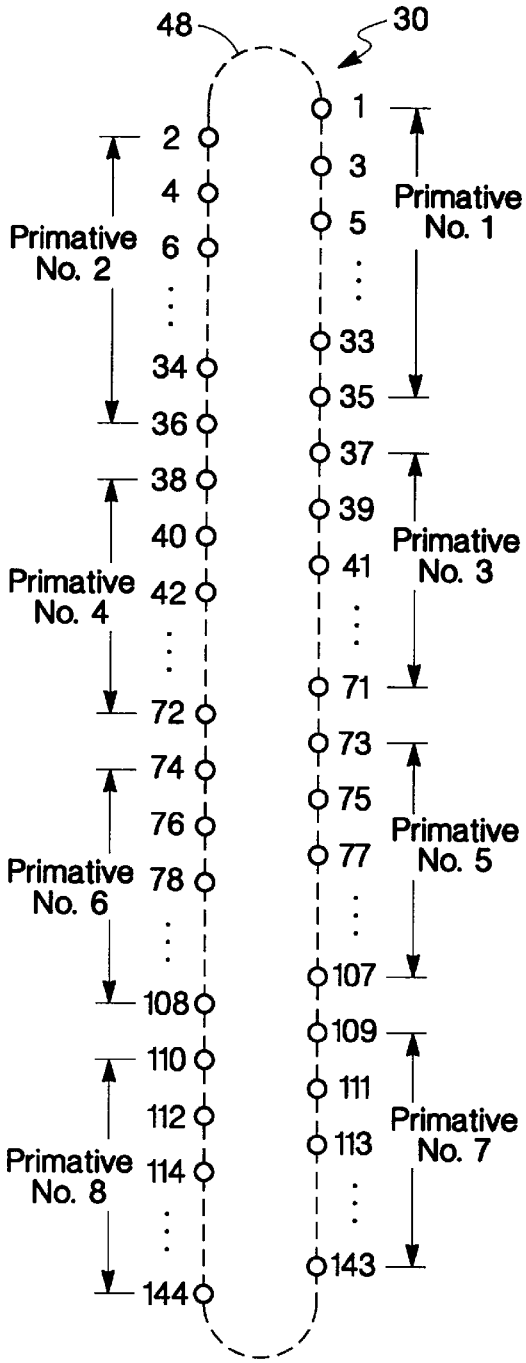
FIG. 6 depicts an arrangement of drop generators into the 8 primitive groupings for a single color of the 3-color printhead shown in FIG. 5.

FIG. 6 depicts the plurality of drop generators 30 associated with yellow ink on printhead 24. In the preferred embodiment there are 144 drop generators associated with the yellow ink. Each of these drop generators are defined on the printhead 24. An ink feed slot 48, shown in ghost, allows ink to flow from an ink chamber within the ink cartridge 14 shown in FIG. 2 to an ink chamber (not shown) defined within the printhead 24. Upon activation of the resistor adjacent the ink chamber by appropriate signals from the primitive generator 46 and address generator 44 shown in FIG. 4, ink is ejected from the nozzles or orifices labeled from 1 to 144, shown in FIG. 6. Each of the plurality of drop generators 30 are disposed proximate the ink feed slot 48 so that the ink chambers associated with each of the drop generators can be rapidly replenished with ink after ink is dispelled from the drop generator. In the case of thermal inkjet printing, each of the components of the drop generator, namely the ink chamber, the resistor and the orifice or nozzle, must all be located in close proximity. References to the location of the nozzle, resistor and the location of the drop generator will be used interchangeably.

In the preferred embodiment, the drop generators are arranged in parallel rows adjacent the ink feed slot 48. The 144 nozzles associated with yellow ink drop (generators are each offset along a longitudinal axis of the ink feed slot 48. Each nozzle is numbered from 1 to 144 based on position along the longitudinal axis of the ink feed slot 48 with odd numbered nozzles on one side of the ink feed slot 48 and even numbered nozzles on the other side of the ink feed slot 48. Adjacent drop generators are grouped into 18 groupings or primitives, with odd nozzles numbered 1 through 35 grouped into primitive 1, even nozzles numbered 2 through 36 grouped into primitive 2, and so forth. The inkjet printhead 24 receives primitive drive signals from the primitive generator 46 for providing drive current to resistors associated with the corresponding primitive. In addition, the address generator 44 associated with the printer portion 12 provides 18 address signals for activating the switching device associated with each drop generator.

In the preferred embodiment, the primitive generator 46 provides 24 primitive signals with 8 primitive signals associated with each ink color, in this embodiment these ink colors include yellow, magenta, and cyan. In addition, the address generator 44 associated with the printer portion 12 provides 18 address signals for uniquely selecting which drop generator within a primitive to activate. As discussed previously, to activate a drop generator requires that both the primitive drive signal is present and that the proper address for that drop generator is active. Table 1 is a chart illustrating address and primitive connections for each drop generator associated with the printhead 24. The drop generator number refers to the drop generator location along each of the ink feed slots 30, 32, and 34 for the yellow, magenta, and cyan inks, respectively. The drop generator layout for the magenta ink feed slot 32 is similar to the nozzle layout for the yellow ink feed slot 30, except the nozzles are numbered from 145 to 288. Similarly, the drop generator layout for the cyan ink feed slot 34 is similar to the drop generator layout for the yellow ink feed slot 30 except the drop generator numbers range from 289 through 432.

Figure 7:
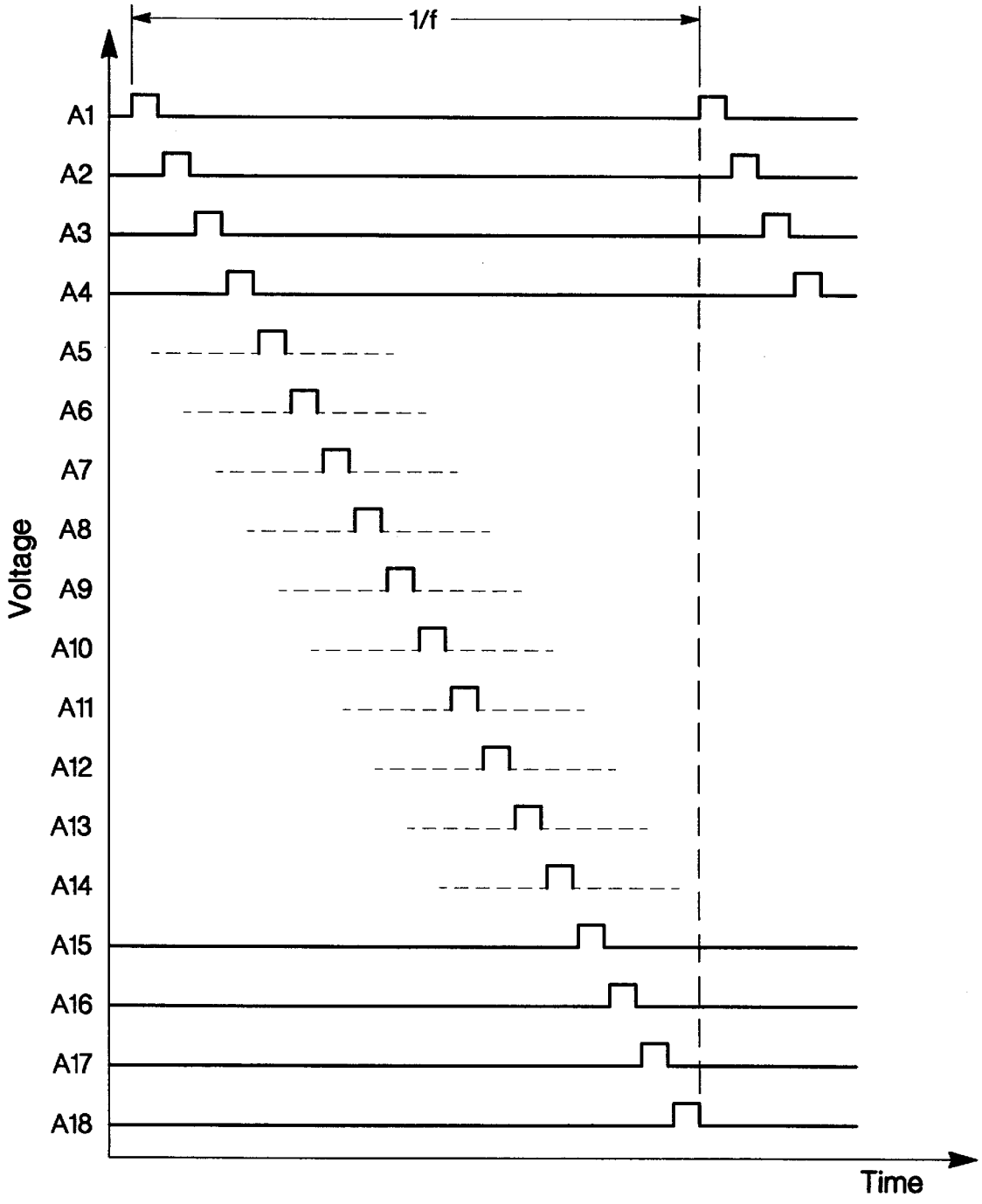
FIG. 7 depicts a simplified timing diagram showing a single activation cycle for the printhead shown in FIG. 5 having 18 address lines.

FIG. 7 depicts a timing diagram illustrating greater detail of the operation of the address generator 44 for enabling addresses 1 through 18 for a printing system 10 operating at a frequency f. The address enable signal will allow each address to be active at a different interval in time thereby preventing no more than one nozzle generator to be active within a primitive at the same time. As discussed previously, for an address to be active, the address generator 44 must receive an address active signal from the controller 42 as well as the address enable signal must be active. Because each drop generator within each primitive has a unique address (see Table 1) and because the address enable signals as shown in FIG. 7 are staggered in time and do not overlap then no more than one drop generator within each primitive will be activated at the same time. Because of the close proximity of drop generators within in each primitive, fluidic cross-talk between nearby drop generators can affect dynamic performance, such as ink chamber refill time. To avoid fluidic cross-talk problems, it is important that no more than one drop generator within each primitive be activated at the same time.

The present invention makes use of 24 primitive signals and 18 address signals for a three color printhead. This preferred embodiment enables the use of a variety of operating frequencies, including the relatively high performance operating frequency of 18 kilohertz. In general, there is a tradeoff between operating frequency

TABLE 1

ADDRESS AND PRIMITIVE FOR EACH DROP GENERATOR

| | Yellow | | | | | | | |
|---|---|---|---|---|---|---|---|---|
| Primitive → | 1 | 2 | 3 | 4 | 5 | 6 | 7 | 8 |
| Address ↓ | | | | | | | | |
| 1 | 1 | 28 | 37 | 64 | 91 | 82 | 127 | 118 |
| 2 | 11 | 2 | 47 | 38 | 101 | 92 | 137 | 128 |
| 3 | 21 | 12 | 57 | 48 | 75 | 102 | 111 | 138 |
| 4 | 31 | 22 | 67 | 58 | 85 | 76 | 121 | 112 |
| 5 | 5 | 32 | 41 | 68 | 95 | 86 | 131 | 122 |
| 6 | 15 | 6 | 51 | 42 | 105 | 96 | 141 | 132 |
| 7 | 25 | 16 | 61 | 52 | 79 | 106 | 115 | 142 |
| 8 | 35 | 26 | 71 | 62 | 89 | 80 | 125 | 116 |
| 9 | 9 | 36 | 45 | 72 | 99 | 90 | 135 | 126 |
| 10 | 19 | 10 | 55 | 46 | 73 | 100 | 109 | 136 |
| 11 | 29 | 20 | 65 | 56 | 83 | 74 | 119 | 110 |
| 12 | 3 | 30 | 39 | 66 | 93 | 84 | 129 | 120 |
| 13 | 13 | 4 | 49 | 40 | 103 | 94 | 139 | 130 |
| 14 | 23 | 14 | 59 | 50 | 77 | 104 | 113 | 140 |
| 15 | 33 | 24 | 69 | 60 | 87 | 78 | 123 | 114 |
| 16 | 7 | 34 | 43 | 70 | 97 | 88 | 133 | 124 |
| 17 | 17 | 8 | 53 | 44 | 107 | 98 | 143 | 134 |
| 18 | 27 | 18 | 63 | 54 | 81 | 108 | 117 | 144 |

| | Magenta | | | | | | | |
|---|---|---|---|---|---|---|---|---|
| Primitive → | 9 | 10 | 11 | 12 | 13 | 14 | 15 | 16 |
| Address ↓ | | | | | | | | |
| 1 | 145 | 172 | 181 | 208 | 235 | 226 | 271 | 262 |
| 2 | 155 | 146 | 191 | 182 | 245 | 236 | 281 | 272 |
| 3 | 165 | 156 | 201 | 192 | 219 | 246 | 255 | 282 |
| 4 | 175 | 166 | 211 | 202 | 229 | 220 | 265 | 256 |
| 5 | 149 | 176 | 185 | 212 | 239 | 230 | 275 | 266 |
| 6 | 159 | 150 | 195 | 186 | 249 | 240 | 285 | 276 |
| 7 | 169 | 160 | 205 | 196 | 223 | 250 | 259 | 286 |
| 8 | 179 | 170 | 215 | 206 | 233 | 224 | 269 | 260 |
| 9 | 153 | 180 | 189 | 216 | 243 | 234 | 279 | 270 |
| 10 | 163 | 154 | 199 | 190 | 217 | 244 | 253 | 280 |
| 11 | 173 | 164 | 209 | 200 | 227 | 218 | 263 | 254 |
| 12 | 147 | 174 | 183 | 210 | 237 | 228 | 273 | 264 |
| 13 | 157 | 148 | 193 | 184 | 247 | 238 | 283 | 274 |
| 14 | 167 | 158 | 203 | 194 | 221 | 248 | 257 | 284 |
| 15 | 177 | 168 | 213 | 204 | 23 | 222 | 267 | 258 |
| 16 | 151 | 178 | 187 | 214 | 241 | 232 | 277 | 268 |
| 17 | 161 | 152 | 197 | 188 | 251 | 242 | 287 | 278 |
| 18 | 171 | 162 | 207 | 198 | 225 | 252 | 261 | 288 |

TABLE 1-continued

ADDRESS AND PRIMITIVE FOR EACH DROP GENERATOR

| | Cyan | | | | | | | |
|---|---|---|---|---|---|---|---|---|
| Primitive → | 17 | 18 | 19 | 20 | 21 | 22 | 23 | 24 |
| Address ↓ | | | | | | | | |
| 1 | 289 | 316 | 325 | 352 | 379 | 370 | 415 | 406 |
| 2 | 299 | 290 | 335 | 326 | 389 | 380 | 425 | 416 |
| 3 | 309 | 300 | 345 | 336 | 363 | 390 | 399 | 426 |
| 4 | 319 | 310 | 355 | 346 | 373 | 364 | 409 | 400 |
| 5 | 293 | 320 | 329 | 356 | 383 | 374 | 419 | 410 |
| 6 | 303 | 294 | 339 | 330 | 393 | 384 | 429 | 420 |
| 7 | 313 | 304 | 349 | 340 | 367 | 394 | 403 | 430 |
| 8 | 323 | 314 | 359 | 350 | 377 | 368 | 413 | 404 |
| 9 | 297 | 324 | 333 | 360 | 387 | 378 | 423 | 414 |
| 10 | 307 | 298 | 343 | 334 | 361 | 388 | 397 | 424 |
| 11 | 317 | 308 | 353 | 344 | 371 | 362 | 407 | 398 |
| 12 | 291 | 318 | 327 | 354 | 381 | 372 | 417 | 408 |
| 13 | 301 | 292 | 337 | 328 | 391 | 382 | 427 | 418 |
| 14 | 311 | 302 | 347 | 338 | 365 | 392 | 401 | 428 |
| 15 | 321 | 312 | 357 | 348 | 375 | 366 | 411 | 402 |
| 16 | 295 | 322 | 331 | 358 | 385 | 376 | 421 | 412 |
| 17 | 305 | 296 | 341 | 332 | 395 | 386 | 431 | 422 |
| 18 | 315 | 306 | 351 | 342 | 369 | 396 | 405 | 432 |

and cost of the printing system 10. Higher printing frequencies are achieved using fewer numbers of addresses and greater numbers of primitives. Because each address is staggered in time fewer numbers of addresses allow for greater operating frequencies for the printing system 10. However, larger numbers of primitives require greater numbers of primitive drivers for supplying drive current to the each of the primitives. These primitive drivers must supply high current for resistor heating and therefore are relatively expensive adding to the manufacturing cost of the printing system 10.

An important aspect of the method and apparatus of the present invention is the fault tolerance achieved by the particular address and primitive interconnections specified in Table 1. As discussed previously, for the inkjet printing system 10 to work properly, the ink cartridges 14 and 16 must be properly seated within the scanning carriage 18 such that electrical connection is made between the printer portion 12 and each of the print cartridges 14 and 16. For the case of print cartridge 14, proper electrical connection requires that each of the 18 electrical contacts associated with each address line and each of the 24 primitive contacts associated with each of the primitive lines must be property established. Contamination or corrosion on these contacts can result in a high resistance electrical connection preventing activation of the switching devices associated with the drop generator. In the event that a single address connection between the printer portion 12 and the print cartridge 14 is not established, then 24 drop generators associated with that address will no longer operate. In addition, there are various failures on the printhead 24 itself or the bonding of the printhead to the flexible circuit 28 (see FIG. 2) that can also result in an address signal failing to reach the printhead 24. For example, if ink is not properly contained on the printhead 24 it can leak between layers on the printhead that can result in shorts that can prevent an address signal from reaching the proper nozzle generator.

The address scheme of the present invention, when used in conjunction with multi-pass printing, effectively masks the effect of a single address out to thereby minimize the reduction of print quality in the output image. The method and apparatus of the present invention masks the effects of effective drop generators due to an address out by distributing these errors in the output image. By distributing error due to drop generator failure, this error is less noticeable to a human observer.

FIGS. 8 through 13 will be used to illustrate how the method and apparatus of the present invention is used to distribute error resulting from a failure of a single address line. It can then be seen that by distributing this error in the proper manner, the error is less noticeable to a human observer.

Figure 8:
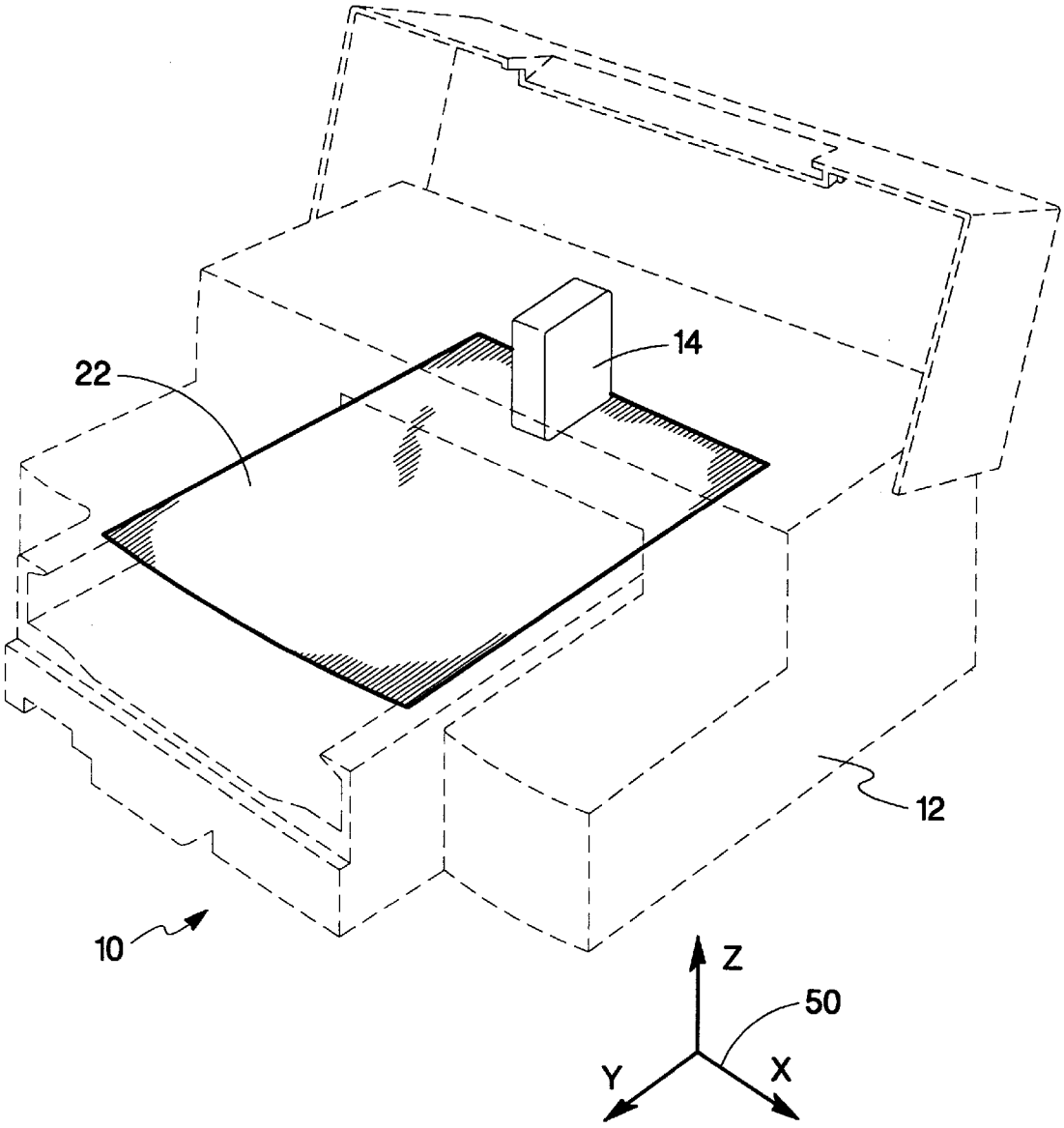
FIG. 8 depicts a simplified schematic representation showing orientation of a scan axis, a media advance axis, and a drop axis for the printing system shown in FIG. 1.

FIG. 8 depicts a simplified representation of the inkjet printing system 10 shown in FIG. 1. The inkjet printing system 10 includes the printer portion 12 and the print cartridge 14. The print cartridge 14 is moved or scanned under the control of the print control device 36 shown in FIG. 3. The ink cartridge 14 is scanned along a scan axis represented by the x-axis in coordinate system 50. In addition, the media 22 is moved under the control of the carriage transport device 40 shown in FIG. 3 along a media advance axis represented by a y-axis in coordinate system 50. The coordinate system 50 represents a set of mutually orthogonal axes, designated x, y, and z. As the print cartridge 14 is scanned while the media 22 is stepped the print control device 36 selectively activates the printhead 24 as shown in FIG. 3 to deposit ink on media for accomplishing printing. Ink droplets ejected from the printhead 24 are dispensed along the z-axis shown in coordinate system 50.

Figure 9:
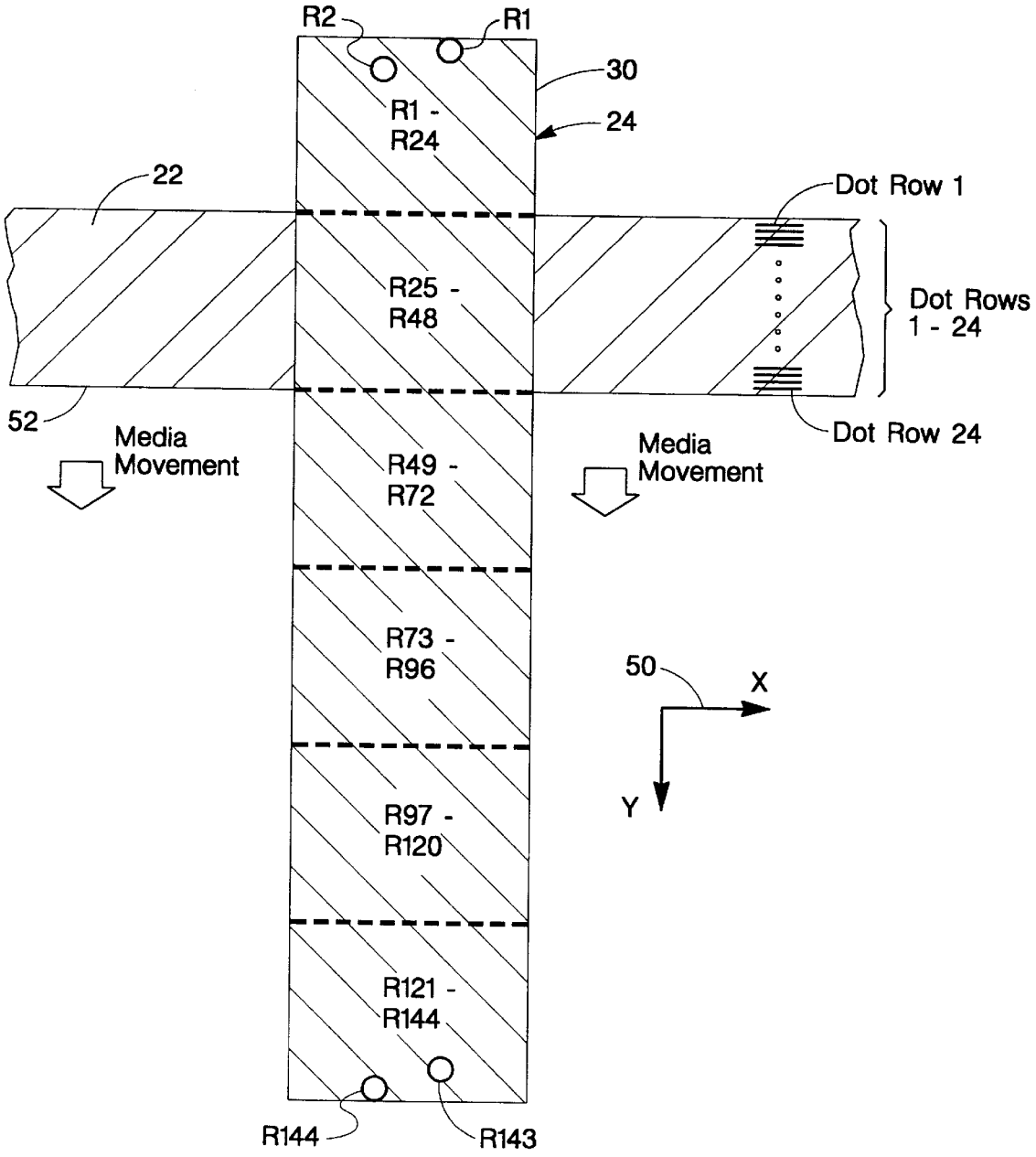
FIG. 9 depicts groupings of resistors for activating corresponding groups of drop generators with the resistor groupings corresponding to each pass of the printhead in 6-pass print-mode.

FIG. 9 depicts a greatly enlarged schematic representation of the plurality of drop generators 30 associated with a single ink color, yellow, for the inkjet printhead 24. The drop generators 1 through 144 are shown in groups of 24 represented by $R_1$. through $R_{24}$, $R_{25}$ through $R_{48}$, $R_{49}$through $R_{72}$, $R_{73}$ through $R_{96}$, R97 through $R_{120}$, $R_{121}$ through $R,_{144}$. The groupings of resistors or drop generators are used to illustrate a multi-pass printing mode for the printing system 10.

The particular multi-pass print-mode shown in FIG. 9 is to represent 6-pass print-mode wherein the printhead prints each swath on the print media using 6 scans of the printhead 24 across the print media 22. As shown in FIG. 9, resistors 1 through 24 that are activated to at least partially print dot rows or lines 1 through 24 on the print media 22. The print media is then stepped in increments such that the next 24 resistors, resistors 25 through 48, are properly aligned with dot row 1 through dot row 24, respectively. The printhead 24 is then scanned along the scan axis to at least partially print dot rows 1 through 24 again. Because each drop generator is offset each drop generator or resistor is aligned with each dot row of the 24 dot rows. The print media is then stepped such that resistors or drop generators $R_{49}$ through $R_{72}$ are aligned with dot rows 1 through 24, respectively. The process is continued until resistors or drop generators $R_{121}$ through $R_{144}$ are used to print dot row 1 through dot row 24, respectively.

In the 6-pass print-mode illustrated in FIG. 9, each dot row or print line within the print swath made up of dot rows 1 through 24 are printed using 6 separate drop generators. For example, dot row 1 is printed using resistors or drop generators $R_1$, $R_{25}$, $R_{49}$, $R_{73}$, $R_{97}$, and $R,_{121}$. Each of these drop generators print ⅙ of dot row 1 over 6 separate scans of the printhead 24 along the scan axis. Between each scan the media 22 is stepped to position the media for the next scan.

Because each print line or dot row on the print media 22 in 6-pass mode is printed with 6 different drop generators, the failure of a single drop generator within the 144 drop generators associated with the yellow ink color will result in less ink droplets being applied in 1 dot row within each print swath of 24 dot rows. The dot row that receives less ink will receive 5/6 the amount of ink of the other dot rows in the print swath.

In the case where an address failure occurs as seen from Table 1, 8 resistors or drop generators will fail, one drop generator associated with each primitive. For example, if address 1 fails, drop generators 1, 28, 37, 64, 91, 82, 127, 118 will all fail which are associated with yellow ink. In addition 8 drop generators will fail associated with each of the magenta and cyan inks also. Focusing on a single ink, for example, the yellow ink, with 8 drop generators failing due to a single address failure, then 8 dot rows within the print swath of 24 dot rows will be printed with less ink. Applicants have recognized that certain drop generator addressing arrangements can result in noticeable print quality reduction. For example, in 6-pass print-mode a failure of a single address line results in 8 drop generators being disabled. If the address arrangement is such that more than one disabled drop generator is required to print the same dot row during different scans of the printhead 24, then the dot row will be printed with less than 1/6 less ink. In this event, 2/6 or 1/3 or more less ink used to print a dot row every print swath is a very noticeable print quality defect.

Another example of a noticeable print quality defect resulting from 8 nozzle failures due to a single address out condition for a single color will now be discussed. Where dot rows are printed with 1/6 less ink by insuring that no more than one defective drop generator prints more than 1 each dot row then there are 8 drop rows in the print swath of 24 dot rows that have reduced ink by 1/6. However, if these 8 dot rows having 1/6 less ink are adjacent each other, this defect or error becomes a very noticeable print quality defect to the human observer.

The method and apparatus of the present invention solves this problem by properly arranging the addressing to ensure that dot rows printed using defective drop generators due to an address out condition are not adjacent each other. In the preferred embodiment of the present invention, the address scheme for each of the drop generators ensures that dot rows printed with defective drop generators are uniformly spaced, thereby uniformly distributing error due to the address out signal within the print swath.

The method and apparatus of the present invention will now be described with respect to FIGS. 10A through 10G to illustrate the method and apparatus of the present invention using a 6-pass print-mode.

FIGS. 10A through 10G each illustrate print media 22 such as paper that is stepped past the printhead 24 along a media advance axis designated as the y-axis in coordinate system 50 while the printhead is scanned along a scan axis represented by the x-axis and coordinate system 50. FIGS. 10A through 10G are not drawn to scale, and are merely intended to illustrate the method and apparatus of the present invention in a multi-pass print-mode. A print swath of interest is represented by cross-hatched portion 52. This print swath represents 24 rows (1/6 of the print generators 30) associated with one ink color for use in a 6-pass print-mode. The method and apparatus of the present invention works equally well for other print colors such as cyan and magenta, but for the sake of simplicity, only one color will be discussed herein.

Figures 10A, 10B, 10C:
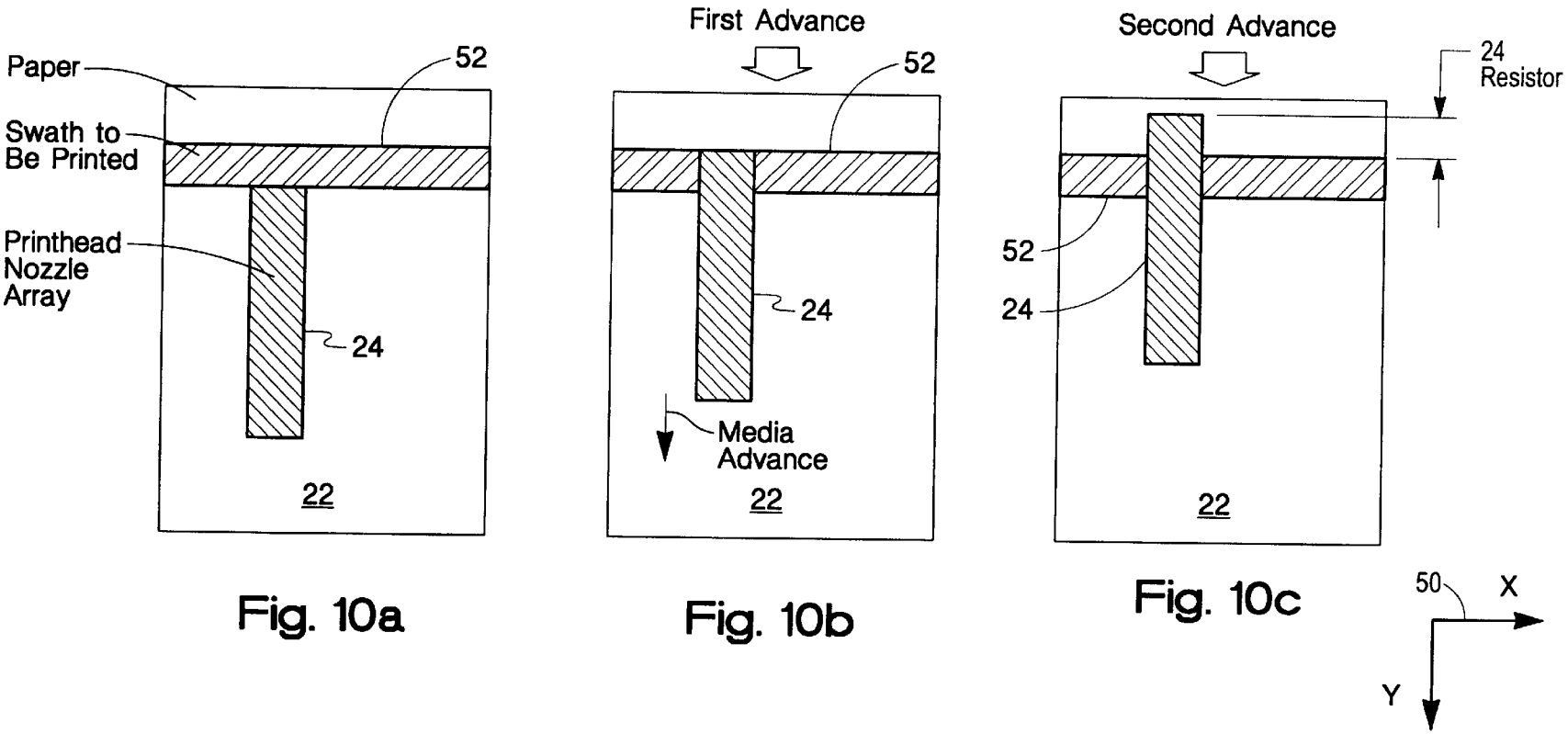
FIGS. 10*a* through 10*g* depict the sequential stepping of the inkjet printhead past a print swath in 6-pass print-mode.

FIG. 10A depicts the printhead 24 prior to printing in the print swath 52 of interest. Therefore there are no drop generators or resistors positioned to print on the swath 52. Assuming an address 1 failure, there are no resistors or drop generators that are positioned over the print swath 52, and therefore, the none of the dot rows or print lines position within the print swath 52 are affected by this address out condition.

FIG. 10B is similar to FIG. 10A except the media has been advanced along the media advance axis so that resistors 1 through 24 are positioned over the print swath 52 of interest. In the event that the entire address 1 line fails to provide an address signals to the printhead 24, drop generator or resistor 1 will fail (see Table 1). In the event that drop generator or resistor 1 fails, the corresponding dot row associated with resistor 1 in print swath 52 is dot row 1.

FIG. 10C is similar to FIG. 10B except the print media 22 is advanced along the media advance axis in a distance equal to resistors. Therefore, resistors 25 through 48 fall within the print swath 52. In the event address 1 fails, resistors or drop generators 28 and 37 within this print swath will not operate. The dot row in which address generator 28 will print within this print swath 52 is dot row 4 which is computed by subtracting the drop generator's position within the printhead which equals 28 minus the number of drop generators which have moved past the print swath interest which equals 24. Similarly, drop generator 37 is used to print dot row 13 within swath 52 which is determined by the drop generator location 37 subtracting the overlap which is equal to 24.

Figures 10D, 10E, 10F, 10G:
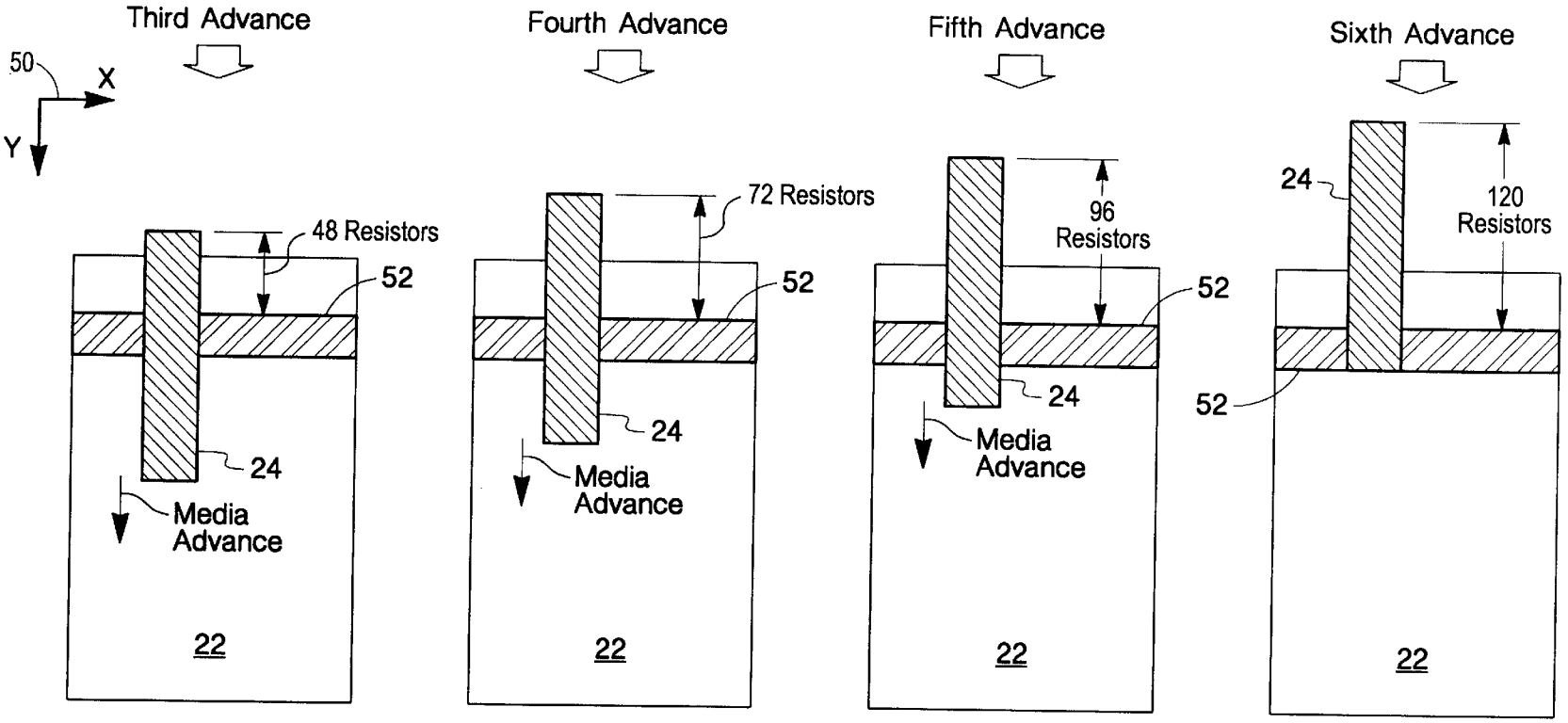

FIG. 10D is similar to FIG. 10C except the print media 22 has been advanced so that the print swath 52 is aligned with the next group of drop generators. The resistors or drop generators positioned over the print swath are resistors 49 through 72. In the event address 1 is not functioning, drop generator 64 fails to operate properly. The dot row corresponding drop generator 64 in print swath 52 is dot row 16. Dot row 16 is achieved by subtracting 48 from 64.

FIG. 10E is similar to FIG. 10D except the print media 22 is advanced to the next group of resistors or drop generators. The resistors or drop generators positioned over the print swath are drop generators 73 through 96. In the event address 1 active signal does not reach the printhead 24, then drop (generators 91 and 82 are inactivated. Drop generators 91 and 82 correspond to dot rows 19 and 10, respectively, in the print swath 52.

FIG. 10F is similar to FIG. 10E except the print media 22 is advanced to the next group of drop generators. Drop generators or resistors 97 through 120 are positioned to print the print swath 52 in FIG. 10F. In the event address 1 signal does not reach the printhead 24, then drop generator 118 will fail to operate, corresponding to dot row 22.

Finally, FIG. 10G is similar to FIG. 10F except the print media 22 is advanced such that resistors or drop generators 121 through 144 are positioned over the print swath 52. In the event that an address 1 signal does not reach the printhead 24, then drop generator 127 will fail to properly activate. Drop generator 127 corresponds to dot row 7 in the print swath 52. Therefore, from FIGS. 10A through 10G, it can be seen that in the event the address line corresponding to address 1 is defective, then 8 drop generators associated with yellow ink will fail to operate. The print lines or dot rows within the print swath 52 that arc printed in 6-pass print-mode result in print lines 1, 4, 7, 10, 13, 16, 19, and 22 that are not properly printed in one of these 6 passes.

Figure 11:
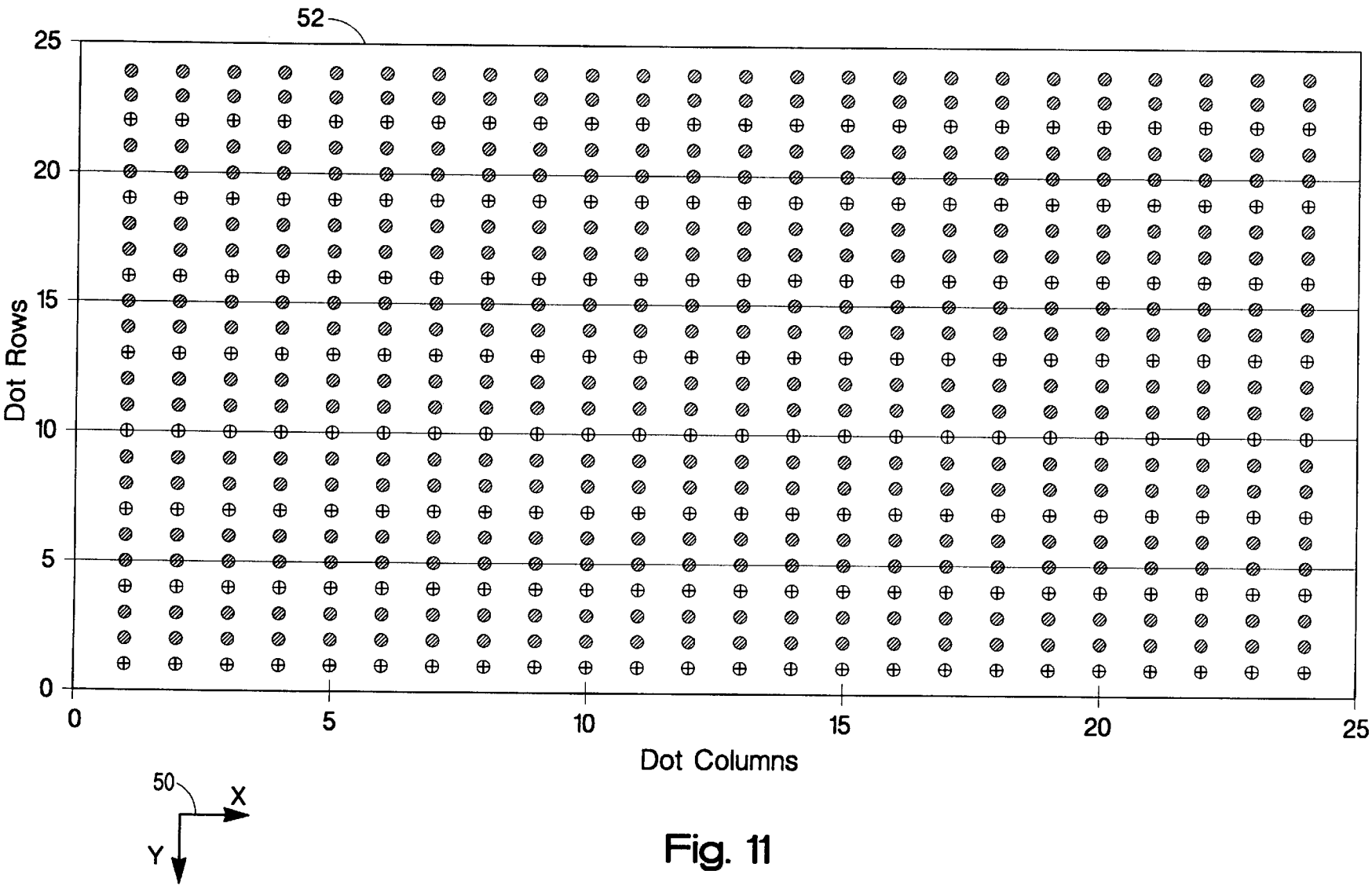
FIG. 11 depicts a schematic representation of individual dot rows and dot columns that make up the print swath illustrating defective dot rows resulting from a single address failure.

FIG. 11 depicts the print swath 52 having 24 print rows or dot rows 2, 3, 5, 6, 8, 9, 11, 12, 14, 15, 17, 18, 20, 21, 23, and 24 properly printed without defect in the event that address 1 fails to provide an activation signal to all drop generators associated with address 1. The remaining print lines in the print swath 52 have been printed with a non-operating drop generator for 1 pass of the 6 passes. Therefore, these print lines or dot rows can be considered printed at 5/6 strength. The addressing arrangement of the present invention provides a uniform distribution of error resulting from inactive drop generators due to a single address out. This error is preferably distributed throughout the print swath 52. Because each line or dot row that is printed by a nonoperating drop generator due to address 1 failure is spaced every third dot row, this error is uniformly distributed throughout the print swath 52. In addition, error resulting from address 1 out is distributed such that each line printed with an inoperative drop generator due to address 1 out is printed with this inactive drop generator on only one of the 6 passes in 6-pass multi-pass mode. Each of these print lines or dot rows printed with an inactive drop generator are spaced from other dot rows printed within inactive drop generators so that an averaging effect performed by the human eye tends to minimize the visual effect of this error.

A single print swath 52 is discussed in FIGS. 10 and 11 for simplicity. The entire print media 22 can be thought of as being composed of a series of print swaths 52. Each print swath 52 within the print media 22 will be printed in a manner similar to the print swath 52 discussed above.

In general, for a printing system 10 that operates in a multi-pass printing mode where printing is accomplished using P passes and where the address system makes use of A separate, independent address lines, then where A divided by P is an integer quantity, the minimum dot row pitch between two affected dot rows is equal to A divided by P when a single address line is inactivated. For example, for the printing system 10 described in FIGS. 9 and 10, wherein 6-pass print-mode is used and 18 address lines, then $$\frac{A}{P} = 3$$

which represents the pitch or distance between 2 dot rows which are affected by the address out condition.

Figure 12:
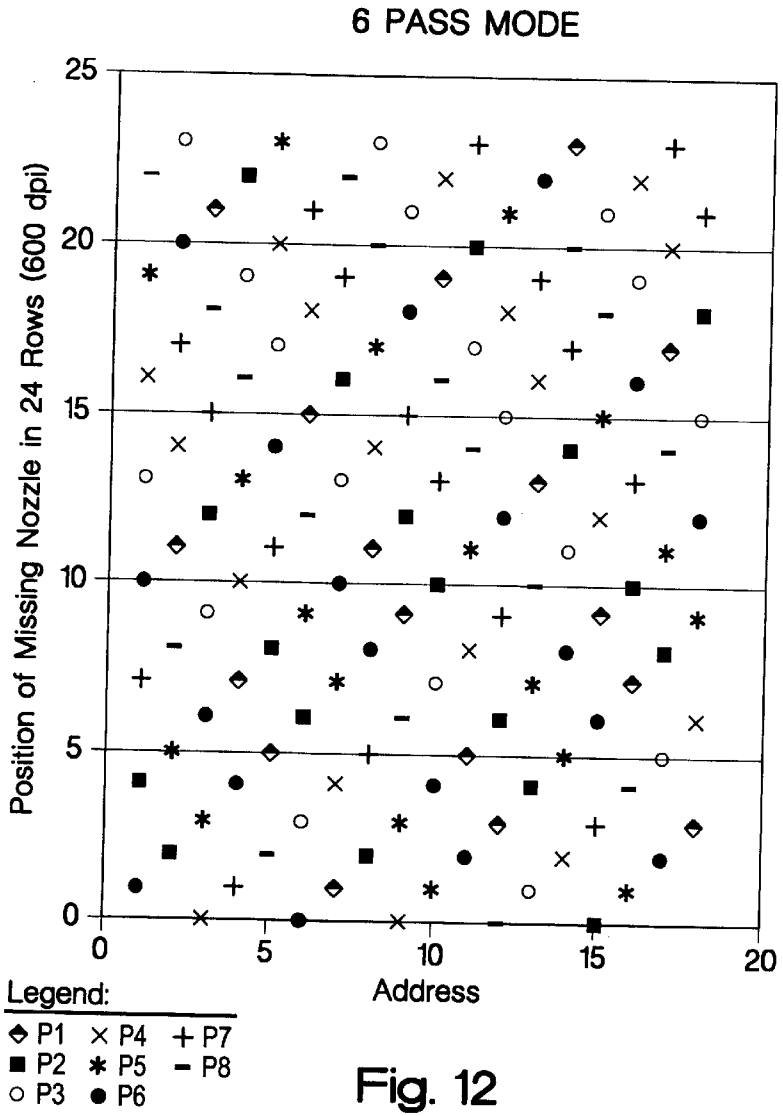
FIG. 12 depicts a chart showing for each corresponding address, the corresponding print line, and corresponding primitive that is activated to print that line in 6-pass print-mode.

FIG. 12 depicts a chart of primitives for corresponding address and position of failed drop generator in the print swath 52 for the printhead 24 operating in 6-pass print-mode within the printing system 10. For each address shown on the horizontal axis each primitive that is activated by this address is at least 3 dot rows apart with the dot rows shown on the vertical axis. Therefore, a single address failure will result in error in the output image that is spaced or distributed in the output image such that the error in the image on media is less noticeable to the human observer. Furthermore, this error is uniformly spaced so that the error in the output image due to an address failure is less noticeable.

Figure 13:
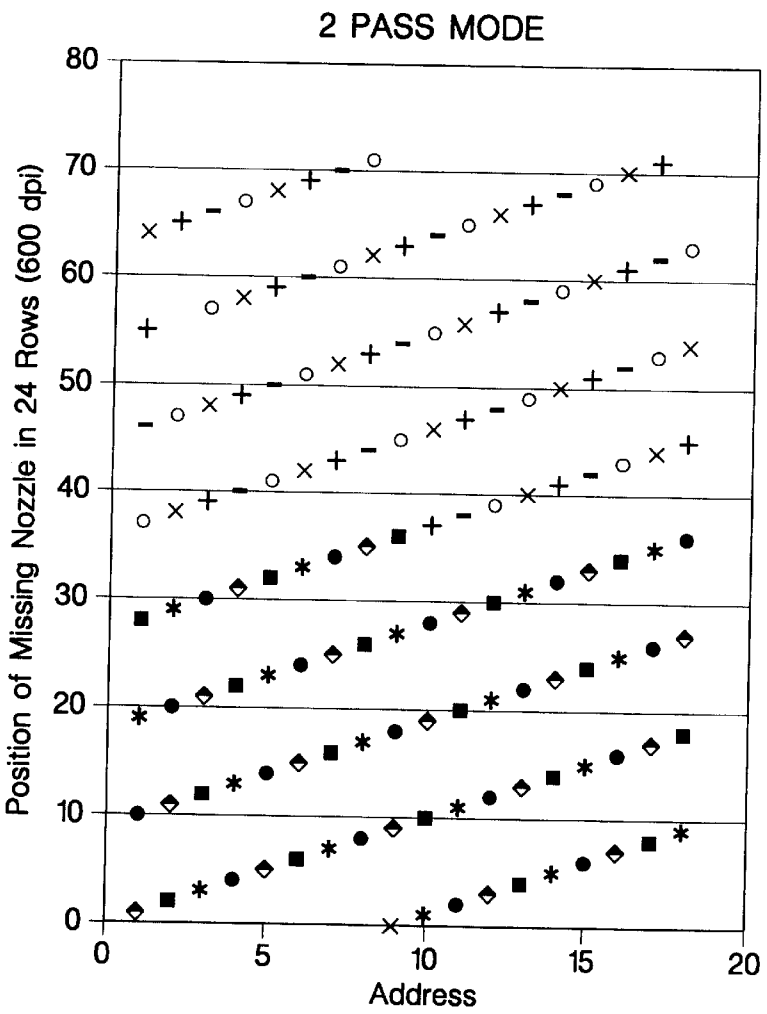
FIG. 13 depicts a chart showing for each corresponding address, the corresponding print line, and corresponding primitive that is activated to print that line in 2-pass print-mode.

FIG. 13 depicts a chart of primitives for corresponding address and position of failed drop generator in the print swath 52 for the printhead 24 operating in 2-pass print-mode within the printing system 10. FIG. 13 is similar to FIG. 12 in that there are 8 dot rows between each primitive that is activated by a given address that is shown on the horizontal axis. This error is uniformly distributed within the image on media to be less noticeable to the human observer.

What is claimed is:

1. An inkjet printhead for use in an inkjet printing system for depositing ink on media, the inkjet printhead having a plurality of drop generators disposed on the printhead that are responsive to first and second select signals for selectively depositing ink on media, the inkjet printhead comprising:

a plurality of contacts for receiving first and second select signals from the inkjet printing system;

a plurality of electrical conductors each electrically connected between each of the plurality of contacts and selected drop generators of the plurality of drop generators; and wherein in a multi-pass print-mode the plurality of electrical conductors are connected to the plurality of drop generators to uniformly distribute error resulting from a failure of one of the plurality of electrical conductors to provide one of the first and second select signals to the plurality of drop generators.

2. The inkjet printhead of claim 1 wherein the first select signal is an address select signal and the second select signal is a primitive drive signal.

3. The inkjet printhead of claim 1 wherein the plurality of drop generators are arranged in two rows with each row having a central axis that is oriented orthogonally to a printhead scan direction and wherein individual drop generators in each row are offset from each other along the central axis so that each drop generator is positioned to print a different print line as the inkjet printhead is moved along the scan axis.

4. The inkjet printhead of claim 2 wherein error is an error resulting from a failure of one of the plurality of electrical conductors to provide an address select signal to the plurality of drop generators and wherein uniform distribution of the error is a fixed number of print lines between each print line that is effected by the failure of one of the electrical conductors to provide the address select signal.

5. The inkjet printhead of claim 1 wherein in the multi-pass print-mode the inkjet printhead is moved relative to print media in a first pass activating a first drop generator of the plurality of drop generators to partially print a print line and the inkjet printhead is moved relative to print media in a second pass activating a second drop generator, different from the first drop generator, of the plurality of drop generators to partially print the print line.

6. The inkjet printhead of claim 2 wherein in the multi-pass mode the inkjet printhead is moved relative to the print media in 6 separate passes with each pass activating a different drop generator of the plurality of drop generators for depositing ink to form each print line and wherein the failure of one of the plurality of electrical conductors to provide the corresponding address select signal to the plurality of drop generators results in error that is uniformly spaced every three print lines.

7. The inkjet printhead of claim 2 wherein in the multi-pass mode the inkjet printhead is moved relative to the print media in 2 separate passes with each pass activating a different drop generator of the plurality of drop generators for depositing ink to form each print line and wherein the failure of one of the plurality of electrical conductors to provide the corresponding address select signal to the plurality of drop generators results in error that is uniformly spaced by every 9 print lines.

8. An inkjet printhead for use in an inkjet printing system, the inkjet printhead having a plurality of drop generators responsive to address and primitive signals for selectively depositing ink drops along print lines that together form a print swath as the inkjet printhead moves relative to the print media in a scan direction, the inkjet printing system having a multi-pass print-mode wherein the inkjet printhead is moved relative to print media along the scan direction more than once and wherein more than one of the plurality of drop generators activated to deposit ink drops along the same print line in the print swath, the inkjet printhead comprising:

a plurality of address contacts for receiving address signals from the inkjet printing system;

a plurality of primitive contacts for receiving primitive signals from the inkjet printing system;

a plurality of primitive conductors with each of the plurality of primitive conductors electrically connected between each of the plurality of primitive contacts and each of a second plurality of drop generators;

a plurality of address conductors with each of the plurality of address conductors electrically connected between each of the plurality of address contacts and each of the second plurality of drop generators, the plurality of address conductors connected to each of the second plurality of drop generators so that each of the plurality of address conductors is connected to a different drop generator within the second plurality of drop generators; and wherein the plurality of address conductors and the plurality of primitive conductors are connected to the plurality of drop generators to ensure that each line printed using drop generators connected to the same address contact have a fixed number of print lines therebetween.

9. The inkjet printhead of claim 8 wherein in the multipass mode the inkjet printhead is moved relative to the print media in 6 separate passes with each pass activating a different drop generator of the plurality of drop generators for depositing ink to form each print line and wherein each line printed using the same address contact has 2 print lines therebetween.

10. The inkjet printhead of claim 8 wherein in the multi-pass mode the inkjet printhead is moved relative to the print media in 2 separate passes with each pass activating a different drop generator of the plurality of drop generators for depositing ink to form each print line and wherein each line printed using the same address contact has 2 print lines therebetween.

11. The inkjet printhead of claim 8 wherein the printhead is a three color printhead and wherein the plurality of address contacts is 18 and the plurality of primitive contacts is 24.

12. An inkjet printhead for use in an inkjet printing system, the inkjet printhead having a plurality of drop generators responsive to address and primitive signals for selectively depositing ink drops along print lines that together form a print swath as the inkjet printhead moves relative to the print media in a scan direction, the inkjet printing system having a multi-pass print-mode wherein the inkjet printhead is moved relative print media along the scan direction more than once and wherein more than one of the plurality of drop generators is activated to deposit ink drops along the same print line in the print swath, the inkjet printhead comprising:

a plurality of primitive conductors with each of the plurality of primitive conductors electrically connected between each of the plurality of primitive contacts and each of a second plurality of drop generators;

a plurality of address conductors with each of the plurality of address conductors electrically connected between each of the plurality of address contacts and each of the second plurality of drop generators, each of the plurality of address conductors are connected to each of the second plurality of drop generators so that for a multi-pass printing system that makes use of P passes, a failure of a single address conductor of the plurality of address conductors results in at least (A/P)-1 integer print lines disposed between print lines that are affected by the failure of the single address conductor where A represents the number of address conductors in the plurality of address conductors.

13. The inkjet printhead of claim 12 wherein the multipass printing system makes use of 6 pass print-mode and wherein the number address conductors associated with the printhead is 18 and wherein 2 print lines are disposed between print lines that are affected by the failure of the single address conductor.

14. The inkjet printhead of claim 12 wherein the multipass printing system makes use of 2 pass print-mode and wherein the number address conductors associated with the printhead is 18 and wherein 8 print lines are disposed between print lines that are affected by the failure of the single address conductor.

15. A method for reducing effects of drop generator failure for a printing system having an inkjet printhead responsive to address and primitive signals for selectively activating a plurality of drop generators for depositing ink on media, the printing system having a scanning carriage for scanning the inkjet printhead along a scan axis across media to accomplish printing, the method comprising:

scanning the inkjet printhead in a multi-pass print-mode wherein each line printed along the scan axis is printed in a plurality of scans of the inkjet printhead and each scan of the plurality of scans makes use of a different drop generator selected from the plurality of drop generators; and activating the address and primitive signals to selectively activate the plurality of drop generators to uniformly distribute errors resulting from failure of one of the address and primitive signals from activating corresponding drop generators so that visual effects of this error is reduced.

16. The method for reducing effects of drop generator failure for a printing system of claim 15 wherein the plurality of scans is 6 scans and wherein the uniform distribution of errors is providing 2 print lines between each print line effected by failure of one of the address and primitive signals.

17. The method for reducing effects of drop generator failure for a printing system of claim 15 wherein the multipass print-mode makes use of 6 pass print-mode and wherein the number address conductors associated with the printhead is 18 and wherein there are 2 lines print lines are disposed between print lines that are affected by the failure of the single address conductor.

18. T he inkjet printhead of claim 15 wherein the multipass print-mode makes use of 2 pass print-mode and wherein the number address conductors associated with the printhead is 18 and wherein there are 8 lines print lines are disposed between print lines that are affected by the failure of the single address conductor.

19. A method for forming address and primitive conductors for providing address and primitive signals to each drop generator of a plurality of drop generators associated with an inkjet printhead, the method comprising:

forming primitive conductors with each primitive conductor electrically connected to each of a second plurality of drop generators of the plurality of drop generators with each of the second plurality of drop generators for each primitive conductor being different;

forming address conductors with each address conductor connected to only one drop generator associated with each of the second plurality of drop generators; and wherein printing in a multi-pass print mode the plurality of address and primitive conductors are connected to the plurality of drop generators to uniformly distribute error resulting from a failure of one of the plurality of electrical conductors to provide one of the address or primitive signals to the plurality of drop generators.

20. The method for forming address and primitive conductors of claim 19 wherein the primitive conductors provide drive current to corresponding heating resistors and address conductors provide control signals for selectively activating switching devices associated with each heating resistor.

21. The method for forming address and primitive conductors of claim 19 wherein the printhead is a 3 color printhead and wherein the plurality of address contacts is 18 and the plurality of primitive contacts is 24.

22. The method for forming address and primitive conductors of claim 19 wherein error is an error resulting from a failure of one of the plurality of electrical conductors to provide an address select signal to the plurality of drop generators and wherein uniform distribution of the error is a fixed number of print lines between each print line that is affected by the failure of one of the electrical conductors to provide the address select signal.

23. An inkjet printhead for use in an inkjet printing system for depositing ink on media, the inkjet printhead having a plurality of drop generators disposed on the printhead, the inkjet printhead comprising:

a group of drive contacts for receiving a group of drive signals from the inkjet printing system and a group of drive conductors with each drive conductor of the group of drive conductors electrically connected between each drive contact of the group of drive contacts and a group of drop generators selected from the plurality of drop generators;

a group of enable contacts for receiving a group of enable signals from the inkjet printing system and a group of enable conductors with each enable conductor of the group of enable conductors electrically connected between each enable contact of the group of enable contacts and a group of drop generators selected from the plurality of drop generators; and wherein printing in a multi-pass print mode the enable conductors and drive conductors are electrically connected to selected drop generators to distribute error resulting from a failure of one of the plurality of the enable conductors to provide the enable signal to the group of drop generators connected thereto.

24. The inkjet printhead of claim 23 wherein the plurality of drop generators are arranged in a two rows on either side of an ink feed slot having a central axis that is oriented orthogonally to a printhead scan direction and wherein individual drop generators in each row are offset from each other along the central axis so that each drop generator is positioned to print a different print line as the inkjet printhead is moved along the scan axis.

25. The inkjet printhead of claim 23 wherein error is an error resulting from a failure of one of the plurality of enable conductors to provide an address select signal to the plurality of drop generators and wherein distribution of the error is a fixed number of print lines between each print line that is effected by the failure of one of the enable conductors to provide the address select signal.

26. The inkjet printhead of claim 23 wherein the number enable conductors associated with the printhead is 18 and wherein there are at least one print line disposed between print lines that are affected by the failure of the single enable conductor.

27. The inkjet printhead of claim 23 wherein the inkjet printhead is a 3 color printhead and the number drive conductors associated with the printhead is 24 and the number of enable conductors associated with the printhead is 18.

28. The inkjet printhead of claim 23 wherein the enable conductors and drive conductors are electrically connected to selected drop generators to maximally distribute error resulting from a failure of one of the plurality of the enable conductors to provide the enable signal to the group of drop generators connected thereto.

* * * * *

UNITED STATES PATENT AND TRADEMARK OFFICE

CERTIFICATE OF CORRECTION

PATENT NO. : 6,190,000 B1
DATED : February 20, 2001
INVENTOR(S) : Paul R. Krouss et al.

It is certified that error appears in the above-identified patent and that said Letters Patent is hereby corrected as shown below:

Column 18,
Line 4, "in a two" should read -- in two --.

Signed and Sealed this

Eighteenth Day of December, 2001

*Attest:*

*Attesting Officer*

JAMES E. ROGAN
*Director of the United States Patent and Trademark Office*